US007241958B1

(12) United States Patent
Pierce et al.

(10) Patent No.: US 7,241,958 B1
(45) Date of Patent: Jul. 10, 2007

(54) PLUNGER SWITCH

(75) Inventors: Anthony E. Pierce, Elizabethtown, KY (US); Damon K. Spalding, Leitchfield, KY (US)

(73) Assignee: E.M.B. Corporation, Elizabethtown, KY (US)

( * ) Notice: Subject to any disclaimer, the term of this patent is extended or adjusted under 35 U.S.C. 154(b) by 0 days.

(21) Appl. No.: 11/616,421

(22) Filed: Dec. 27, 2006

Related U.S. Application Data

(60) Provisional application No. 60/754,916, filed on Dec. 29, 2005.

(51) Int. Cl.
*H01H 13/00* (2006.01)
*H01H 15/00* (2006.01)

(52) U.S. Cl. ..... 200/16 B; 200/16 D

(58) Field of Classification Search ..... 200/16 B, 200/16 D, 16 A, 273, 341, 296, 242–243, 200/531–532
See application file for complete search history.

(56) References Cited

U.S. PATENT DOCUMENTS 3,663,780 A 5/1972 Golbeck
4,501,940 A * 2/1985 Suzuki ..... 200/16 A
5,063,277 A 11/1991 Takano et al.
5,221,816 A 6/1993 Williams
5,304,753 A * 4/1994 Parrish et al. ..... 200/16 B
5,803,242 A * 9/1998 Takano et al. ..... 200/530
5,959,271 A * 9/1999 Matsuhashi ..... 200/61.41
5,960,940 A * 10/1999 Elting et al. ..... 200/296
6,028,274 A * 2/2000 Harris ..... 200/52 R
6,444,932 B1 * 9/2002 Resmalm ..... 200/334
6,518,528 B2 * 2/2003 Nickerson et al. ..... 200/447

* cited by examiner

*Primary Examiner*—Richard K. Lee
(74) *Attorney, Agent, or Firm*—Stites & Harbison, PLLC; Jeffrey A. Haeberlin; David W. Nagle, Jr.

(57) ABSTRACT

A plunger switch is described. The switch has a carrier having a base portion. The carrier base portion has channels which receive bridge contact members. The bridge contact members are trapped in the channels by a retainer member. The carrier is inserted into a housing with a neck portion extending through an opening in a top of the housing. A clip/stop member is positioned around the neck portion. A button is then attached to the neck portion with a pin. The neck portion and clip/stop member are pushed through the opening into the housing. Spring arms on the clip/stop member spring outward inside the housing to create an up-stop for the carrier with respect to the housing.

11 Claims, 6 Drawing Sheets

PLUNGER SWITCH

CROSS-REFERENCE TO RELATED APPLICATIONS

This application claims priority to U.S. Provisional Patent Application No. 60/754,916, filed Dec. 29, 2005, which application is hereby incorporated by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates to electrical switches. More particularly, this invention relates to an improved plunger switch.

2. Description of Prior Art

Plunger switches are utilized in applications where it is desired to make or break a circuit by either pushing or pulling a button attached to a plunger assembly containing contacts that bridge a gap between terminals of the switch. One such application is in a power take-off circuit of a mower or tractor, where a clutch is engaged to transfer power to, for example, the cutting blades of the mower by pulling out a button of a plunger switch on the mower. The clutch is disengaged by pushing the button back in. In such applications, it is desired that the components of the switch be contained in a substantially sealed housing, in order to keep dirt and other contaminants from fouling the contacts of the switch.

However, the design and assembly of a switch in a substantially sealed housing is problematic. Often, there is not much room to assemble contacts, terminals and other switch components within the housing. Thus, many of the switch components must be assembled outside of the housing, and inserted into the housing in a pre-assembled state.

Additionally, since an operator can exert considerable pulling force on such a button, the plunger assembly must be fairly robust. Otherwise, the operator could pull the button or plunger assembly out of the switch, or break the plunger assembly, destroying the switch. Failure of the plunger assembly under excessive force has been a problem of prior art plunger switches.

Thus, there is a need for an improved plunger switch that overcomes these and other problems of the prior art.

BRIEF SUMMARY OF THE INVENTION

The invention meets these needs, and others.

According to one aspect of the invention, a switch has a plunger assembly, a housing, terminal members, a bridge contact member, and a clip/stop member. The plunger assembly has a carrier member, a button member, and a pin member. The carrier member has a base portion, a body portion projecting upward from the base portion, and a neck portion extending upward from the body portion and defining a pin-receiving aperture. The button member has a generally cylindrical shaped body portion and a generally flat head portion having a diameter greater than the body portion, thereby forming a flange to aid in pulling the button member. The button member body portion has a bottom portion having a pin-receiving aperture and defining a central cavity, the central cavity receiving the carrier member neck portion. The pin member extends through the carrier member neck portion pin-receiving aperture and the button member bottom portion pin-receiving aperture, for attaching the button member to the carrier member. The housing has side walls having a top portion and a bottom portion defining a chamber for receiving the plunger assembly carrier member, a top wall connected around the top portion of the side walls, the top wall defining an opening, and a collar extending upward from the top wall and defining a passage extending from the top wall opening, the passage for receiving and guiding the button member bottom portion and the carrier member neck portion along a path of travel between a pulled position and a pushed position. The terminal members are for switching at least one circuit and are positioned partially within the housing on opposite sides of the carrier member base portion. The bridge contact member is carried by the carrier member base portion such that movement of the carrier member causes the first bridge contact member to move into electrical connection between the first pair of terminal members. The clip/stop member is made from a resilient material and has a central portion and spring arms extending in opposing directions from the central portion. The central portion defines an opening for positioning the clip/stop member around the carrier member neck portion between the carrier member body portion and the button member to form an up-stop for the plunger assembly with respect to the housing.

According to another aspect of the invention, a switch has a housing, a plunger assembly, terminal members, a first bridge contact member, and a retainer member. The housing has side walls defining a chamber. The plunger assembly has a carrier member having a base portion. The base portion has an upper side, a lower side, a first side, a second side opposed to the first side. The lower side defines a first channel running between the first side and the second side, a groove along an interior surface of the channel, and retaining lips along an outer side of the channel. The carrier is positioned substantially within the housing chamber. The terminal members are for switching at least one circuit and are positioned partially within the housing chamber on opposite sides of the carrier member base portion. The first bridge contact member is made of a resilient, electrically conductive material and has a central portion, a first leg extending from a first end of the central portion, and a second leg extending from a second end of the central portion. The central portion has a slight bow. The first leg and the second leg have a curved portion at the widest point of the bridge contact member. The first bridge contact member is received in the carrier member groove such that the first leg and the second leg are biased between the terminal members. The retainer member is received in the carrier member channel, trapping the bridge in the groove. The retainer member is held in place by the respective retaining lips and by a capturing force generated by the slight bow of the bridge contact member central portion.

According to yet another aspect of the invention method of assembling a plunger switch includes: positioning a plurality of bridge contact members in respective grooves along an interior surface of a plurality of channels defined by a lower side of a base portion of a carrier member, the bridge contact members being made of a resilient, electrically conductive material, each bridge contact member having a central portion, a first leg extending from a first end of the central portion, and a second leg extending from a second end of the central portion, each central portion having a slight bow, each of the first leg and the second leg having a curved portion at the widest point of the bridge contact member; inserting fingers of a retainer member in respective carrier member channels, each finger trapping a respective bridge contact member in a respective groove, each of the fingers held in place by respective retaining lips along an outer side of each of the channels and by a capturing force generated by the slight bow of the respective bridge contact member central portions; inserting the carrier member into a housing such that a neck portion of the carrier member extends through a passage defined by a collar and an opening in a top wall of the housing, the carrier member neck portion defining a pin-receiving aperture; positioning the carrier member neck portion through an opening in a central portion of a clip/stop member, the clip/stop member made of a resilient material and having spring arms extending in opposing directions from the central portion; positioning the carrier member neck portion in a central cavity of a body portion of a button member, such that a pin-receiving aperture in the button member body portion is aligned with the neck portion pin-receiving aperture; inserting a pin member through the button member body portion pin-receiving aperture and the carrier member neck portion pin-receiving aperture for attaching the button member to the carrier member; and pushing the carrier member neck portion and the clip/stop member through the collar and into the housing, the clip/stop member spring arms flexing to allow passage through the collar and springing outward inside of the housing to create an up-stop for the carrier member with respect to the housing.

The invention will be better understood by reference to the following detailed description and the appended information.

DETAILED DESCRIPTION OF EXEMPLARY EMBODIMENTS OF THE INVENTION

Advantageously, an exemplary switch according to the invention provides, among other features: 1) a two piece plunger (button and carrier) held together by a pin that allows assembly of bridges to a carrier outside the switch, and assembly of the plunger in the switch; 2) a stainless steel clip/stop having spring arms that extend in the housing after the button is assembled and pushed back down into a normal operating position, preventing the plunger from extending back through the top of the housing; and 3) a retainer that slides in the carrier from the side to hold three bridges in place.

Figure 1:
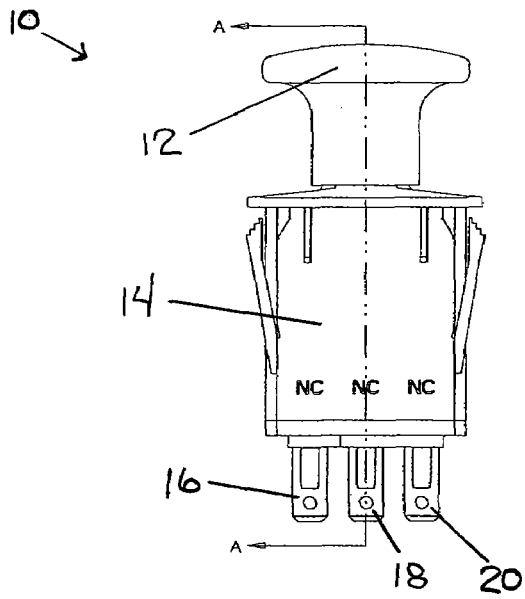
FIG. 1 is front view of an exemplary plunger switch according to the invention.
Figure 2:
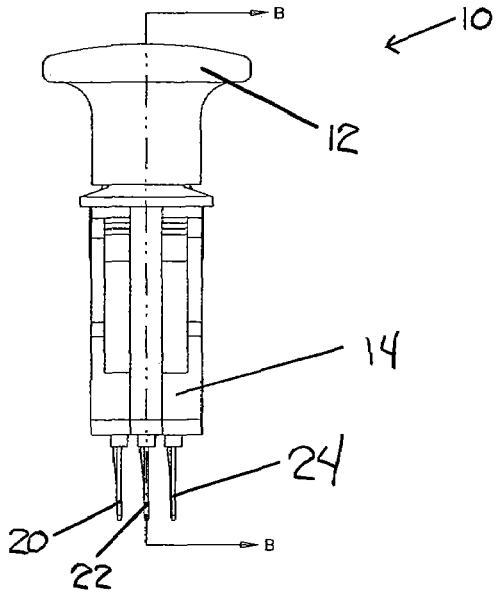
FIG. 2 is a side view of the exemplary plunger switch of FIG. 1.

FIG. 1 and FIG. 2 are a front view and a side view, respectively, of an exemplary plunger switch 10 according to the invention. Visible are a plunger assembly button member 12, a switch housing 14 and a number of terminal members 16, 18, 20, 22, 24. The switch 10 of FIG. 1 and FIG. 2 is shown in a pushed position, where the button member 12 is pushed in toward the housing 14.

Figure 4:
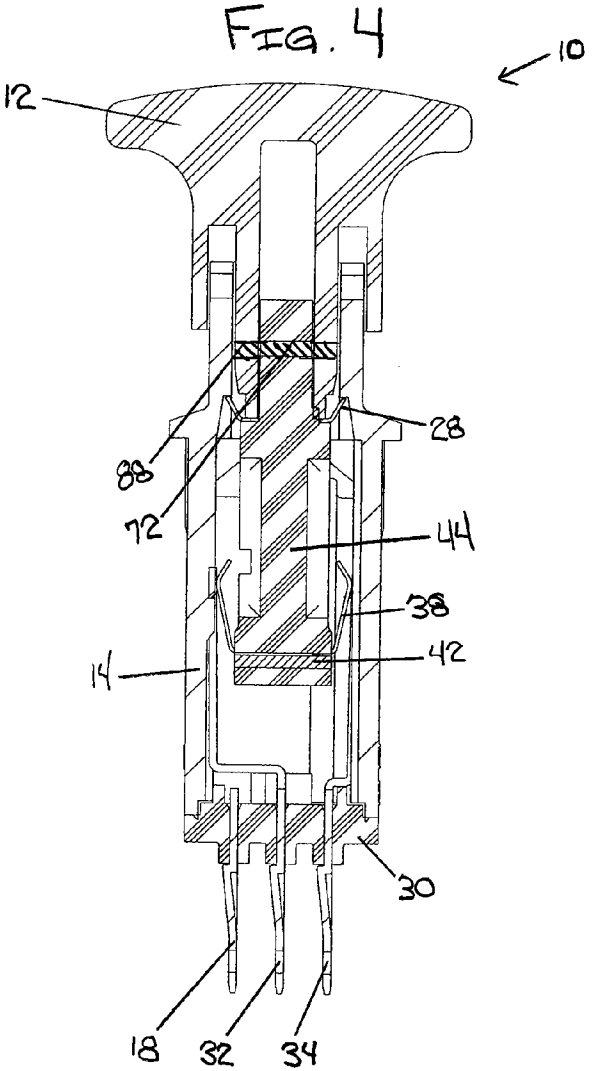
FIG. 4 is a sectional view similar to the view of FIG. 3, but with the plunger switch in a pulled position.
Figure 3:
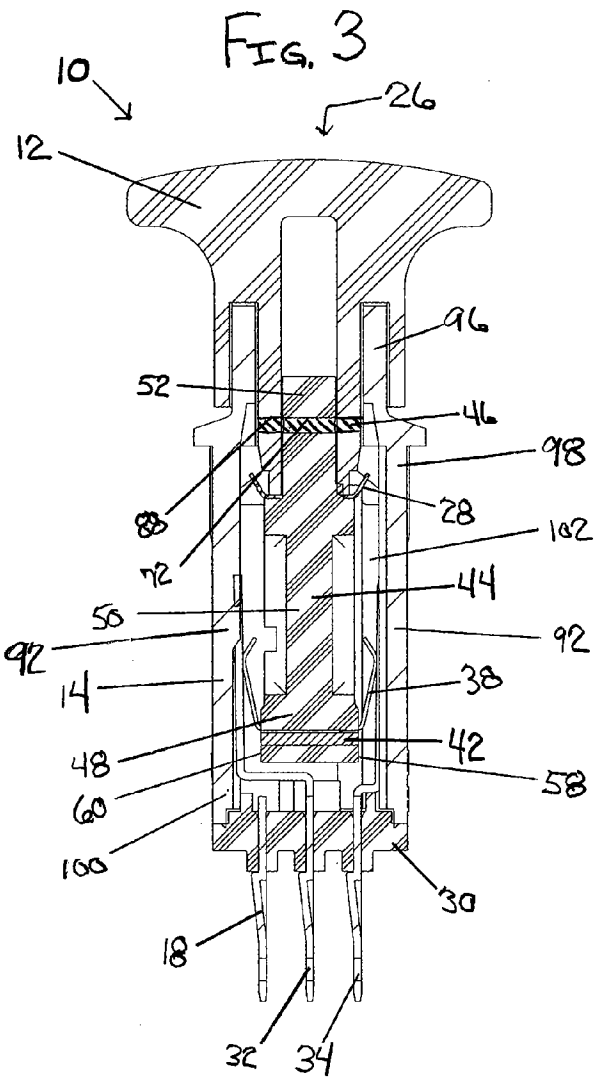
FIG. 3 is a sectional view of the exemplary switch of FIG. 1, indicated by section line A-A in FIG. 1. The plunger switch is in a pushed position.

FIG. 3 and FIG. 4 are sectional views of the exemplary plunger switch 10 of FIG. 1 and FIG. 2 where the section is indicated by the section line A-A in FIG. 1. FIG. 3 shows the button member 12 in a pushed position, and FIG. 4 shows the button member 12 in a pulled position.

Figure 6:
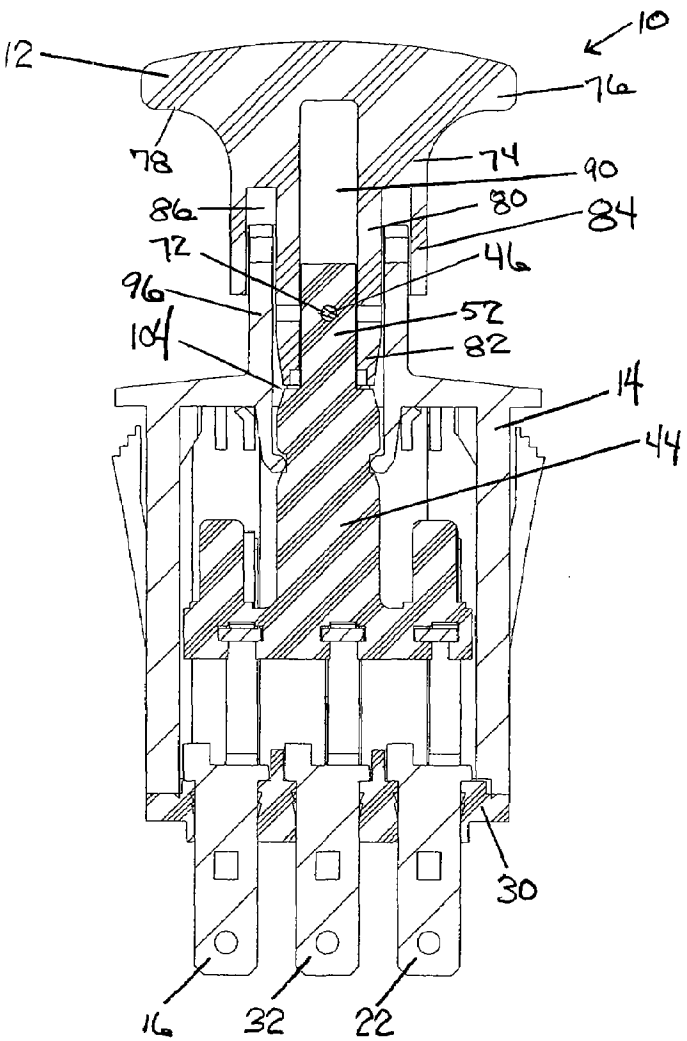
FIG. 6 is a sectional view similar to the view of FIG. 5, but with the plunger switch in a pushed position.
Figure 5:
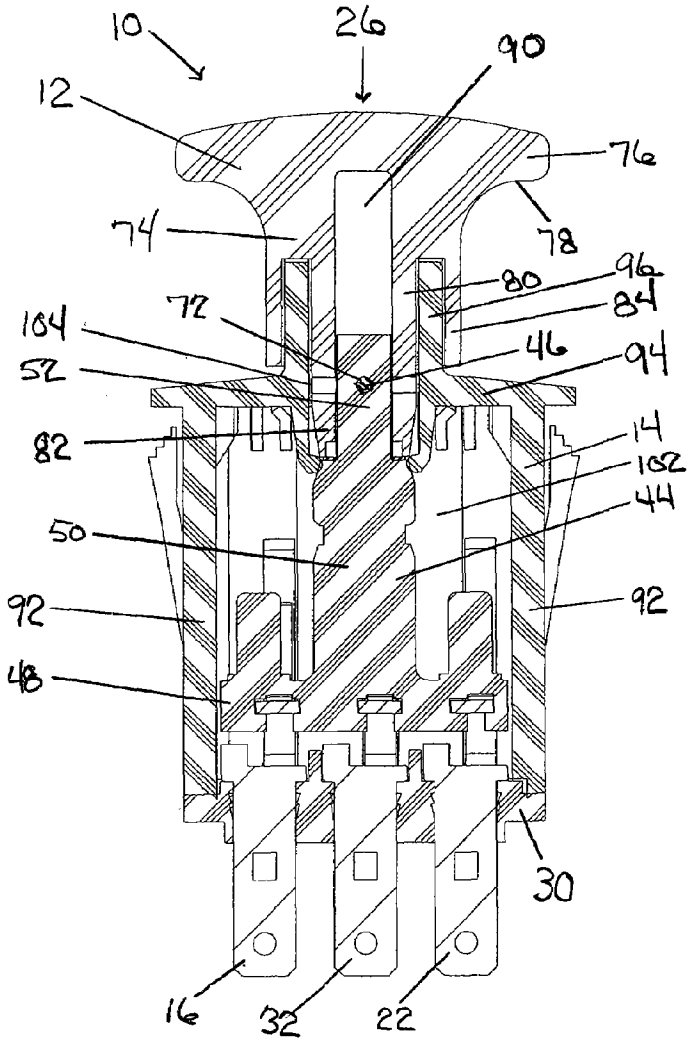
FIG. 5 is a sectional view of the exemplary switch of FIG. 1, indicated by section line B-B in FIG. 2. The plunger switch is in a pushed position.

FIG. 5 and FIG. 6 are sectional views of the switch 10 where the section is indicated by the section line B-B in FIG. 2. FIG. 5 shows the button member 12 in a pushed position, and FIG. 6 shows the button member 12 in a pulled position.

Figure 7:
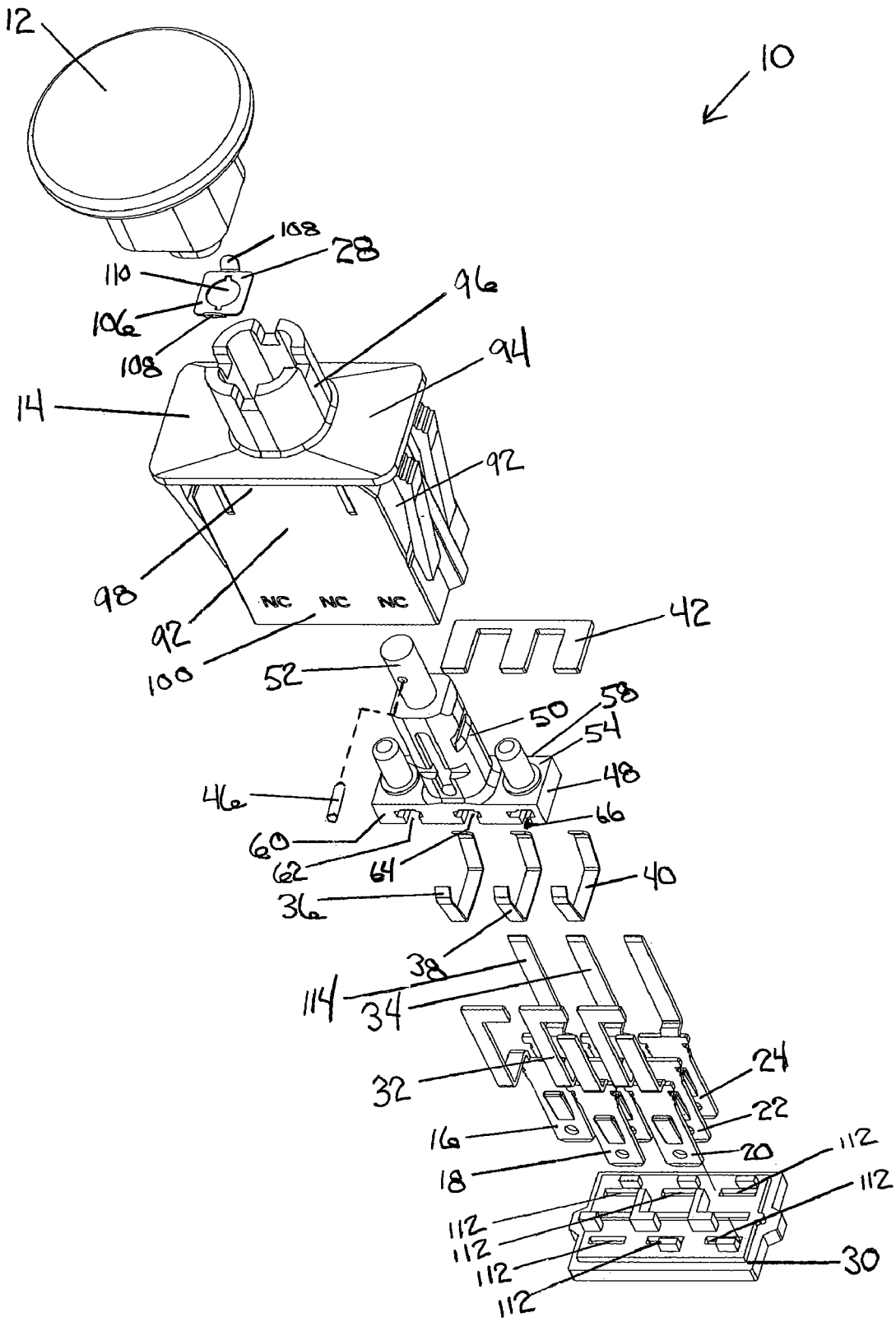
FIG. 7 is an exploded perspective view of the exemplary plunger switch of FIG. 1.

FIG. 7 is an exploded perspective view of the exemplary plunger switch of FIG. 1.

Visible in one or more of FIG. 3 through FIG. 7 are a plunger assembly 26, the switch housing 14, a clip/stop member 28, a cover member 30, bridge contact members 36, 38, 40, a retainer member 42, common terminal members 24, 34, 114, pulled position terminal members 16, 22, 32, and pushed position terminal members 18, 20. The combination of common terminal members 24, 34, 114 and pulled position/pushed position terminal members 16, 22, 32, 18, 20 form respective sets of terminal members. Moving the plunger assembly 26 causes the bridge contact members 36, 38, 40 to make or break connection between the common terminal members 24, 34, 114 and the pulled position/pushed position terminal members 16, 22, 32, 18, 20.

Figure 9:
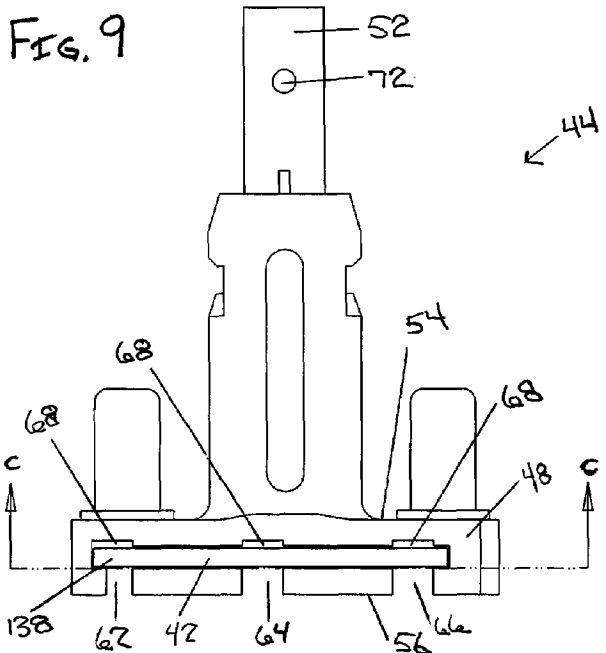
FIG. 9 is a front view of an exemplary carrier member of a plunger switch according to the invention, and shown in FIG. 7. An exemplary retainer is also shown.

The plunger assembly 26 has a carrier member 44, a button member 12, and a pin member 46. The carrier member 44 (also shown in FIG. 9 through FIG. 11) has a base portion 48, a body portion 50, and a neck portion 52. The carrier member base portion 48 has an upper side 54, a lower side 56, a first side 58, and a second side 60 opposed to said first side 58. The lower side 56 defines a first channel 62, a second channel 64 and a third channel 66 running between said first side 58 and said second side 60. The first channel 62, second channel 64, and said third channel 66 are substantially parallel to each other. The carrier member 44 also has a groove 68 along an interior surface of each channel 62, 64, 66, retaining lips 70 along an outer side of each channel 62, 64, 66, and a recess 67 along the first side 58. The body portion 50 projects upward from the upper side 54 of the base portion 48. The neck portion 52 extends upward from the body portion 50 and defines a pin-receiving aperture 72. The button member 12 has a generally cylindrical shaped body portion 74 and a generally flat head portion 76. The head portion 76 has a diameter greater than the diameter of the body portion 74, forming a flange 78 to aid in pulling the button member 12. The button member body portion 74 has a middle portion 80, a bottom portion 82 and a skirt 84 extending around the middle portion 80. Additionally, the skirt 84 defines an annular cavity 86 around the middle portion 80. The bottom portion 82 has a pin-receiving aperture 88 and defines a central cavity 90 for receiving the carrier member neck portion 52. The pin member 46 extends through the carrier member neck portion pin-receiving aperture 72 and the button member bottom portion pin-receiving aperture 88, for attaching the button member 12 to the carrier member 44.

The switch housing 14 has side walls 92, a top wall 94, and a collar 96. The side walls 92 have a top portion 98 and a bottom portion 100. The side walls 92 define a chamber 102 for receiving the plunger assembly carrier member 44. The top wall 94 is connected around the top portion 98 of the side walls. The top wall defines an opening 104. The collar 96 extends upward from the top wall 94 and defines a passage extending from the top wall opening 104. The passage is for receiving and guiding the button member bottom portion 82 and the carrier member neck portion 52 along a path of travel between a pulled position and a pushed position. The collar 96 is received in the button member annular cavity 86.

The clip/stop member 28 has a central portion 106 and spring arms 108 extending upward and in opposing directions from the central portion 106. The clip/stop member 28 is made from a resilient material. The central portion 106 defines an opening 110 for receiving said carrier member neck portion 52. The clip/stop member 28 allows the pin member 46 to be inserted through the button member pin-receiving aperture 88 and the carrier member pin-receiving aperture 72 while said carrier member base portion 48 is in said housing 14, and allows the plunger assembly 26 to be pushed into the housing 14 and retained in operating position in the housing 14. The clip/stop member spring arms 108 flex to allow the clip/stop member 28 to pass through the collar 96, and spring outward inside of the housing chamber 102 to create an up-stop for the carrier member 44 with respect to the housing 14.

The cover member 30 has a plurality of terminal slots 112. The cover member 30 engages the housing side walls bottom portion 100 to close the bottom portion of the housing chamber 102.

The common terminal members 24, 34, 114 are received in one of the cover member terminal slots 112 and held by the cover member 30 such that a portion of the common terminal members 24, 34, 114 are positioned on a first side of said carrier member 48 in alignment with first ends of said channels 62, 64, 66. Further, the three pulled position terminal members 16, 22, 32, are received in one of the cover member terminal slots 112 and held by the cover member 30 such that a portion of the pulled position terminal members 16, 22, 32 are positioned on a second side of said carrier member 48 in alignment with second ends of said channels 62, 64, 66 when the plunger assembly 26 is in a pulled position. Still further, the two pushed position terminal members 18, 20 are received in one of the cover member terminal slots 112 and held by the cover member 30 such that a portion of the pushed position terminal members 18, 20 are positioned on the second side of the carrier member 48 in alignment with the second ends of the channels 62, 64, 66 when the plunger assembly is in a pushed position. Each terminal member 16, 18, 20, 22, 24, 32, 34, 114 is electrically conductive.

Figure 8:
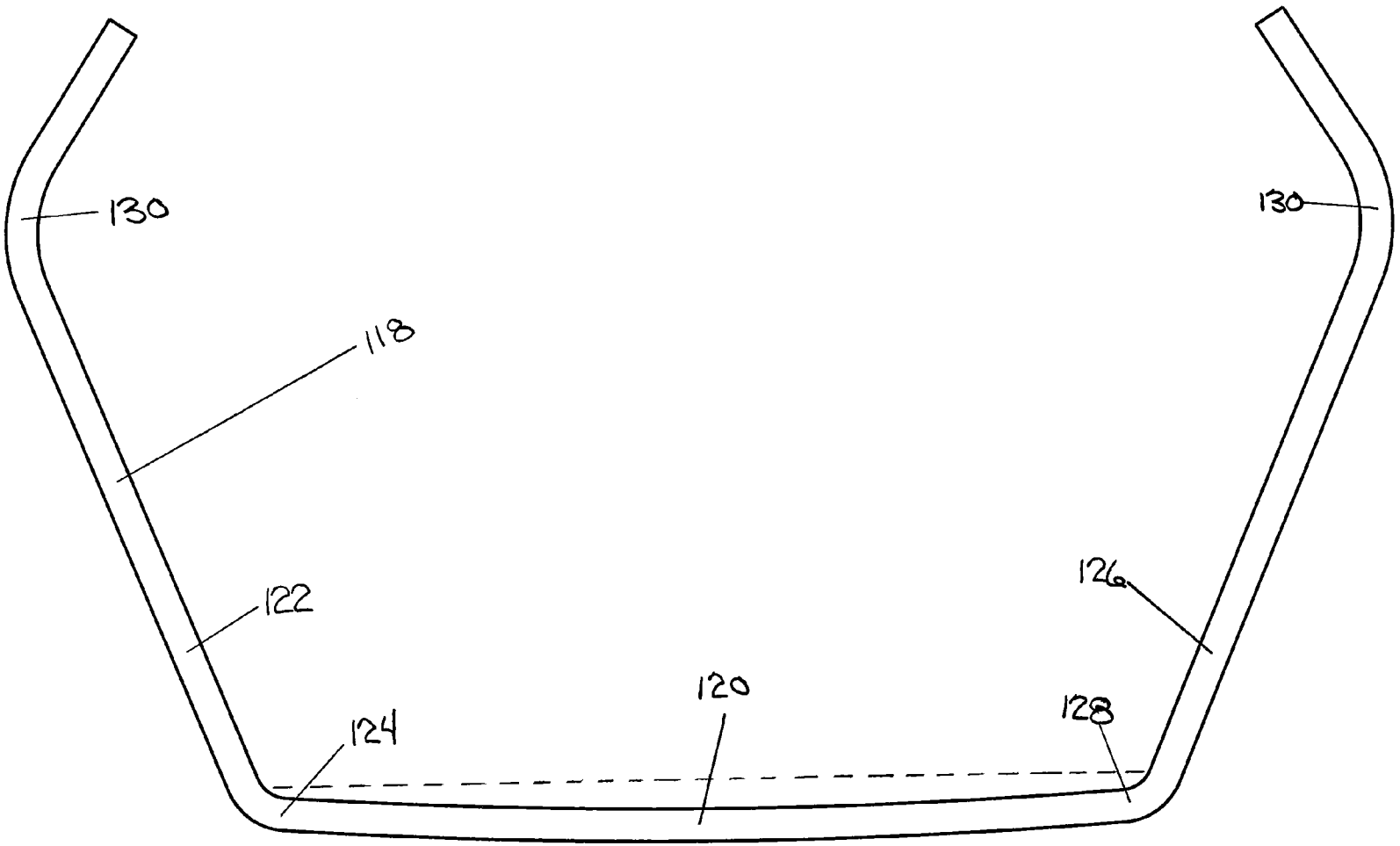
FIG. 8 is a side view of an exemplary bridge contact member, as shown in FIG. 7.

FIG. 8 shows a representative bridge contact member 118, such as one of the three bridge contact members 36, 38, 40 of FIG. 3 through FIG. 7. The representative bridge contact member 118 has a central portion 120, a first leg 122 extending from a first end 124 of the central portion 120, and a second leg 126 extending from a second end 128 of said central portion 120. The central portion 120 has a slight bow. Each of the first leg 122 and the second leg 126 has a curved portion 130 at the widest point of the bridge contact member 118.

Returning now to FIG. 3 through FIG. 7, each of the bridge contact members 36, 38, 40 is received in a respective carrier member groove 68 to move with the carrier member 44. The respective legs are biased between respective common terminal members 24, 34, 114 and one of the pulled position terminal members 16, 22, 32 or the pushed position terminal members 18, 20 (or the housing side wall 92 for the bridge contact member position where there is no pushed position terminal). Each of the bridge contact members 36, 38, 40 is made of a resilient, electrically conductive material.

Figure 11:
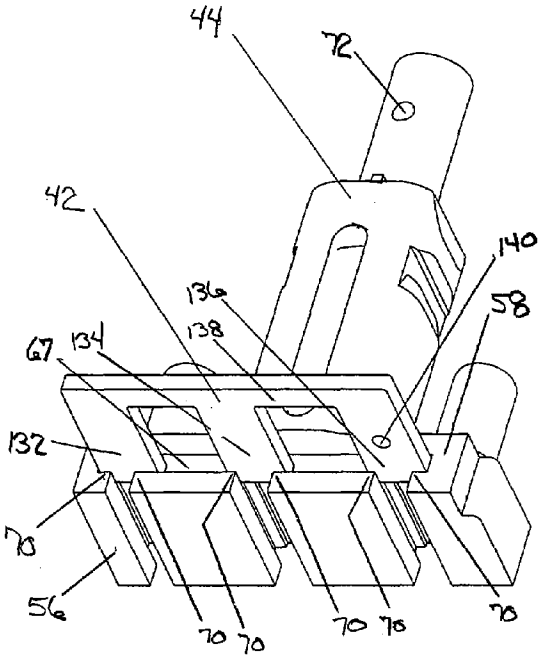
FIG. 11 is a perspective view of the exemplary carrier member and retainer as shown in FIG. 10.
Figure 10:
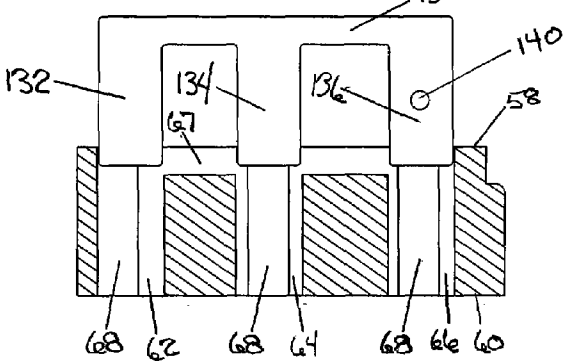
FIG. 10 is a sectional view of the carrier member of FIG. 9, indicated by section line C-C in FIG. 8. The exemplary retainer is also shown.

As shown in FIG. 10 and FIG. 11, the retainer member 42 has three fingers 132, 134, 136 and a connecting portion 138 connecting the fingers 132, 134, 136 together at a common end of the fingers 132, 134, 136. Each finger 132, 134, 136 is received in a respective carrier member channel 62, 64, 66, and the connecting portion 138 is received in the carrier member first side recess 67. Each finger 132, 134, 136 traps a respective bridge 36, 38, 40 (FIG. 3 through FIG. 7) in a respective groove 68. Each finger is held in place by the respective retaining lips 70 and by a capturing force generated by the slight bow of the respective bridge contact member central portion 120 (FIG. 8). Additionally, the retainer member 42 may be heat staked to the carrier member 44. The retainer member 42 may also have a bump 140 to maintain correct insertion orientation, as the fingers 132, 134, 136 of the exemplary retainer member 42 have slightly different spacing.

Assembly of the exemplary switch 10 is accomplished as follows: positioning the bridge contact members 36, 38, 40 in respective grooves 68 along an interior surface of a plurality of channels 62, 64, 66 defined by the lower side 56 of the base portion 48 of the carrier member 44; inserting the fingers 132, 134, 136 of the retainer member 42 in respective carrier member channels 62, 64, 66, each finger 132, 134, 136 trapping a respective bridge contact member 36, 38, 40 in a respective groove 68, each finger 132, 134, 136 held in place by the retaining lips 70 along the outer side of each channel 62, 64, 66 and by a capturing force generated by the slight bow of the respective bridge contact member central portions 120; inserting the carrier member 44 into the housing 14 such that the neck portion 52 of the carrier member 44 extends through the passage defined by the collar 96 and the opening 104 in the top wall 94 of the housing 14; positioning the carrier member neck portion 52 through the opening 110 in the central portion 106 of the clip/stop member 28; positioning the carrier member neck portion 52 in the central cavity 90 of the body portion 74 of the button member 12, such that the pin-receiving aperture 88 in the button member body portion 74 is aligned with the neck portion pin-receiving aperture 72; inserting the pin member 46 through the button member body portion pin-receiving aperture 88 and the carrier member neck portion pin-receiving aperture 72 for attaching the button member 14 to the carrier member 44; and pushing the carrier member neck portion 52 and the clip/stop member 28 through the collar 96 and into the housing chamber 102, the clip/stop member spring arms 108 flexing to allow passage through the collar 96 and springing outward inside of the housing chamber 102 to create an up-stop for the carrier member 44 with respect to the housing 14. Advantageously, the collar 96 also serves to trap the pin member 46 in the carrier member pin-receiving aperture 72 and the button member pin-receiving aperture 88. Tight tolerances may also create a frictional holding force between the pin member 46 and the pin-receiving apertures 72, 88.

Additionally, assembly of the exemplary switch 10 includes: inserting the terminal members 16, 18, 20, 22, 24, 32, 34, 114 into the terminal slots 112 in the cover member 30; and positioning the cover member around the bottom portion 100 of the housing side walls 92 to close the housing chamber 102 and to position the terminal members 16, 18, 20, 22, 24, 32, 34, 114 in alignment with the bridge contact members 36, 38, 40, such that movement of the carrier member 44 causes the bridge contact members 36, 38, 40 to switch electrical connections between the terminal members 16, 18, 20, 22, 24, 32, 34, 114.

One of ordinary skill in the art will recognize that additional steps and configurations are possible without departing from the teachings of the invention. This detailed description, and particularly the specific details of the exemplary embodiment disclosed, is given primarily for clearness of understanding and no unnecessary limitations are to be understood therefrom, for modifications will become evident to those skilled in the art upon reading this disclosure and may be made without departing from the spirit or scope of the claimed invention.

What is claimed is:

1. A switch comprising:

a plunger assembly having:

a carrier member having:

a base portion;

a body portion projecting upward from said base portion; and a neck portion extending upward from said body portion and defining a pin-receiving aperture;

a button member having a generally cylindrical shaped body portion and a generally flat head portion having a diameter greater than the body portion, thereby forming a flange to aid in pulling said button member, said button member body portion having a bottom portion having a pin-receiving aperture and defining a central cavity, said central cavity receiving said carrier member neck portion; and a pin member extending through said carrier member neck portion pin-receiving aperture and said button member bottom portion pin-receiving aperture, for attaching said button member to said carrier member;

a housing having:

side walls having a top portion and a bottom portion defining a chamber for receiving said plunger assembly carrier member;

a top wall connected around said top portion of said side walls, said top wall defining an opening; and a collar extending upward from said top wall and defining a passage extending from said top wall opening, said passage for receiving and guiding said button member bottom portion and said carrier member neck portion along a path of travel between a pulled position and a pushed position;

a first set of terminal members for switching at least one circuit, said terminal members positioned partially within said housing on opposite sides of said carrier member base portion;

a first bridge contact member carried by said carrier member base portion such that movement of said carrier member causes said first bridge contact member to move into electrical connection between said first pair of terminal members; and a clip/stop member made from a resilient material, said clip/stop member having a central portion and spring arms extending in opposing directions from said central portion, said central portion defining an opening for positioning said clip/stop member around said carrier member neck portion between said carrier member body portion and said button member to form an up-stop for said plunger assembly with respect to said housing.

2. The switch of claim 1, wherein said button member body portion further has a middle portion and a skirt extending around said middle portion defining an annular cavity around said middle portion, said button member annular cavity receiving said housing collar such that said skirt and said collar provide a barrier to contaminants from entering said housing.

3. The switch of claim 2, further comprising a cover member for assembly to said bottom portion of said housing side walls, said cover member defining a plurality of terminal slots, said terminal slots receiving said terminal members.

4. The switch of claim 1, wherein said base portion has an upper side, a lower side, a first side, a second side opposed to said first side, said lower side defining a first channel running between said first side and said second side, a groove along an interior surface of said first channel, retaining lips along an outer side of said channel;

wherein said first bridge contact member is made of a resilient, electrically conductive material and has a central portion, a first leg extending from a first end of said central portion, and a second leg extending from a second end of said central portion, said central portion having a slight bow, each of said first leg and said second leg having a curved portion at the widest point of said first bridge contact member, said first bridge contact member being received in said carrier member groove such that said first leg and said second leg are biased between said first pair of terminal members or said housing wall;

further comprising a retainer member received in said first channel, said retainer member trapping said first bridge contact member in said groove, said retainer member being held in place by said retaining lips and by a capturing force generated by said slight bow of said first bridge contact member central portion.

5. The switch of claim 1, further comprising:

a second set of terminal members and a third set of terminal members for switching at least two additional circuits, said second set of terminal members and said third set of terminal members positioned partially within said housing on opposite sides of said carrier member base portion;

a second bridge contact member and a third bridge contact member; and a retainer member having three fingers and a connecting portion connecting said fingers together at a common end of said fingers;

wherein said base portion has an upper side, a lower side, a first side, a second side opposed to said first side, said lower side defining a first channel, a second channel and a third channel running between said first side and said second side, said first channel, said second channel and said third channel being substantially parallel to each other, a groove along an interior surface of each channel, retaining lips along an outer side of said channel and a recess along said first side of said base portion;

wherein said bridge contact members are made of a resilient, electrically conductive material, each said bridge contact member having a central portion, a first leg extending from a first end of said central portion, and a second leg extending from a second end of said central portion, each said central portion having a slight bow, each of said first leg and said second leg having a curved portion at the widest point of said bridge contact member, said bridge contact members being received in said carrier member grooves such that each of said first legs and said second legs are biased between said respective sets of terminal members; and wherein each said retainer member finger is received in a respective carrier member channel, said connecting portion being received in said carrier member first side recess, each said finger trapping a respective bridge in a respective groove, each said finger being held in place by said respective retaining lips and by a capturing force generated by said slight bow of said respective bridge contact member central portion.

6. A switch comprising:

a housing having side walls defining a chamber;

a plunger assembly having a carrier member having a base portion, said base portion having an upper side, a lower side, a first side, a second side opposed to said first side, said lower side defining a first channel running between said first side and said second side, a groove along an interior surface of said channel, retaining lips along an outer side of said channel, said carrier positioned substantially within said housing chamber;

a first set of terminal members for switching at least one circuit, said terminal members positioned partially within said housing chamber on opposite sides of said carrier member base portion;

a first bridge contact member made of a resilient, electrically conductive material, said bridge contact member having a central portion, a first leg extending from a first end of said central portion, and a second leg extending from a second end of said central portion, said central portion having a slight bow, said first leg and said second leg having a curved portion at the widest point of said bridge contact member, said first bridge contact member being received in said carrier member groove such that said first leg and said second leg are biased between said terminal members; and a retainer member received in said carrier member channel, said retainer member trapping said first bridge in said groove, said retainer member held in place by said retaining lips and by a capturing force generated by said slight bow of said bridge contact member central portion.

7. The switch of claim 6, further comprising a clip/stop member made from a resilient material, said clip/stop member having a central portion and spring arms extending in opposing directions from said central portion, said central portion defining an opening;

wherein said carrier member further has:

a body portion projecting upward from said base portion; and a neck portion extending upward from said body portion and defining a pin-receiving aperture;

wherein said plunger assembly further has:

a button member having a generally cylindrical shaped body portion and a generally flat head portion having a diameter greater than the body portion, thereby forming a flange to aid in pulling said button member, said button member body portion having a bottom portion having a pin-receiving aperture and defining a central cavity, said central cavity receiving said carrier member neck portion; and a pin member extending through said carrier member neck portion pin-receiving aperture and said button member bottom portion pin-receiving aperture, for attaching said button member to said carrier member;

wherein said housing side walls further have a top portion and a bottom portion;

wherein said housing further has:

a top wall connected around said top portion of said side walls, said top wall defining an opening; and a collar extending upward from said top wall and defining a passage extending from said top wall opening, said passage for receiving and guiding said button member bottom portion and said carrier member neck portion along a path of travel between a pulled position and a pushed position;

said clip/stop member positioned around said carrier member neck portion between said carrier member body portion and said button member to form an up-stop for said plunger assembly with respect to said housing.

8. The switch of claim 7, wherein said button member body portion further has a middle portion and a skirt extending around said middle portion defining an annular cavity around said middle portion, said button member annular cavity receiving said housing collar such that said skirt and said collar provide a barrier to contaminants from entering said housing.

9. The switch of claim 8, further comprising a cover member for assembly to said bottom portion of said housing side walls, said cover member defining a plurality of terminal slots, said terminal slots receiving said terminal members.

10. A method of assembling a plunger switch, said method comprising:

positioning a plurality of bridge contact members in respective grooves along an interior surface of a plurality of channels defined by a lower side of a base portion of a carrier member, said bridge contact members being made of a resilient, electrically conductive material, each said bridge contact member having a central portion, a first leg extending from a first end of said central portion, and a second leg extending from a second end of said central portion, each said central portion having a slight bow, each of said first leg and said second leg having a curved portion at the widest point of said bridge contact member;

inserting fingers of a retainer member in respective carrier member channels, each said finger trapping a respective bridge contact member in a respective groove, each of said fingers held in place by respective retaining lips along an outer side of each of said channels and by a capturing force generated by said slight bow of said respective bridge contact member central portions;

inserting said carrier member into a housing such that a neck portion of said carrier member extends through a passage defined by a collar and an opening in a top wall of said housing, said carrier member neck portion defining a pin-receiving aperture;

positioning said carrier member neck portion through an opening in a central portion of a clip/stop member, said clip/stop member made of a resilient material and having spring arms extending in opposing directions from said central portion;

positioning said carrier member neck portion in a central cavity of a body portion of a button member, such that a pin-receiving aperture in said button member body portion is aligned with said neck portion pin-receiving aperture;

inserting a pin member through said button member body portion pin-receiving aperture and said carrier member neck portion pin-receiving aperture for attaching said button member to said carrier member; and pushing said carrier member neck portion and said clip/stop member through said collar and into said housing, said clip/stop member spring arms flexing to allow passage through said collar and springing outward inside of said housing to create an up-stop for said carrier member with respect to said housing.

11. The method of claim 10, further comprising:

inserting a plurality of sets of terminal members into a cover member having a plurality of terminal slots; and positioning said cover member around a bottom portion of said housing side walls to close said housing chamber and to position said terminal members in alignment with said bridge contact members, such that movement of said carrier member causes said bridge contact members to switch electrical connections between said terminal members.

* * * * *